US011183786B2

(12) United States Patent
Sabo et al.

(10) Patent No.: US 11,183,786 B2
(45) Date of Patent: Nov. 23, 2021

(54) LOW COST, HIGH RELIABILITY SLIDING POWER CONNECTROR

(71) Applicant: FCI USA LLC, Etters, PA (US)

(72) Inventors: James M. Sabo, Marysville, PA (US); Clarence Randall Fry, Mount Holly Springs, PA (US)

(73) Assignee: FCI USA LLC, Etters, PA (US)

( * ) Notice: Subject to any disclaimer, the term of this patent is extended or adjusted under 35 U.S.C. 154(b) by 71 days.

(21) Appl. No.: 16/656,016

(22) Filed: Oct. 17, 2019

(65) Prior Publication Data

US 2020/0127402 A1 Apr. 23, 2020

Related U.S. Application Data

(60) Provisional application No. 62/747,527, filed on Oct. 18, 2018.

(51) Int. Cl.

| | |
|---|---|
| ***H01R 12/00*** | (2006.01) |
| ***H01R 12/72*** | (2011.01) |
| ***H01R 13/24*** | (2006.01) |
| ***H01R 13/405*** | (2006.01) |
| ***H01R 12/70*** | (2011.01) |

(52) U.S. Cl.

CPC ..... *H01R 12/721* (2013.01); *H01R 12/7005* (2013.01); *H01R 13/2442* (2013.01); *H01R 13/405* (2013.01)

(58) Field of Classification Search

CPC ..... H01R 41/10; H01R 25/14; H01R 25/142; H01R 25/145; H01R 25/147

USPC ..... 439/79, 78; 361/727

See application file for complete search history.

(56) References Cited

U.S. PATENT DOCUMENTS 5,807,120 A * 9/1998 Matthews ..... H01R 12/58 439/748
5,830,018 A 11/1998 Simmel
6,071,152 A 6/2000 Achammer et al.
(Continued)

FOREIGN PATENT DOCUMENTS

CN 206148685 U 5/2017

OTHER PUBLICATIONS

Sabo et al., High Reliability Sliding Power Connector, U.S. Appl. No. 16/656,068, filed Oct. 17, 2019.

*Primary Examiner* — Phuong Chi Thi Nguyen
(74) *Attorney, Agent, or Firm* — Wolf, Greenfield & Sacks, P.C.

(57) ABSTRACT

An electronic assembly with a first substrate and electrical connector terminals mounted on the first substrate. The electrical connector terminals have contact fingers and tracks. A bus bar may be aligned by the tracks such that contact surfaces on the contact fingers press against contact surfaces on the bus bar. The bus bar may slide in the tracks such that, when the bus bar is mounted in an electronic system including the electronic assembly, the electrical connector terminals enable the electronic assembly to slide relative to the bus bar. The electronic system may be implemented as a rack, and the electronic assembly may be or include a printed circuit board on which the electrical connector terminals are mounted. The printed circuit board may be slid in and out of the rack while power is supplied from the bus bar to components on the printed circuit board.

28 Claims, 10 Drawing Sheets

(56) References Cited

U.S. PATENT DOCUMENTS

| | | | | |
|---|---|---|---|---|
| 6,280,245 | B1 * | 8/2001 | Han | H01R 13/514 439/541.5 |
| 6,299,492 | B1 * | 10/2001 | Pierini | H01R 13/26 439/884 |
| 7,976,321 | B2 | 7/2011 | Schempp | |
| 8,021,200 | B2 | 9/2011 | Myer et al. | |
| 8,911,251 | B2 | 12/2014 | Ehlen | |
| 9,450,358 | B2 | 9/2016 | Ehlen | |
| 9,693,477 | B1 | 6/2017 | Ehlen | |
| 9,985,403 | B1 | 5/2018 | Herring et al. | |
| 10,756,500 | B2 * | 8/2020 | Herring | H01R 12/7088 |
| 2013/0335913 | A1 | 12/2013 | Brashers et al. | |
| 2020/0127403 | A1 | 4/2020 | Sabo et al. | |

* cited by examiner

LOW COST, HIGH RELIABILITY SLIDING POWER CONNECTROR

RELATED APPLICATIONS

This application claims priority and the benefit under 35 U.S.C. 119(e) of U.S. Provisional Patent Application Ser. No. 62/747,527, filed Oct. 18, 2018, entitled "LOW COST, HIGH RELIABILITY SLIDING POWER CONNECTOR".

BACKGROUND

This patent application relates generally to improvements in electrical connectors, such as a power connector that may be used in equipment racks.

Electronic systems are often assembled from multiple subassemblies installed in an equipment rack. The rack may contain interconnections that carry signals between the subassemblies so that the subassemblies may operate together as a system. The rack may also contain power supplies or other power distribution components that supply power to the subassemblies. For example, an electronic system may be assembled by installing into a rack subassemblies that contain processors, memory, and communications interfaces. These components may be mounted on one or more printed circuit boards ("PCBs") that provide a substrate on which to mount the components. The PCB also has conductive layers and traces that distribute power and signals to or among the components mounted to the PCB.

It is sometimes desirable for the subassemblies to be accessible by an installer, operator or repair technician working with the electronic system. To facilitate access, racks may have drawers in which the subassemblies are placed. When the drawers are pulled out, subassemblies inside can be easily accessed. Though the drawers, with subassemblies inside, might be closed for normal operation of the electronic system, it is sometimes desirable for the system to operate even when a drawer is pulled out.

In some systems, power may be supplied to the electronic components in the drawers through sliding power connectors. A power connector may be attached to a printed circuit board that is at a side or bottom of the drawer. The sliding power connectors may have spring fingers that mate with bus bars carrying power such that power is supplied from the bus bar, through the power connector to the PCB in the subassembly, and then to the electronic components of the subassembly. Such power connectors may supply power to the subassembly when the drawer is opened, when it is closed and when it is being slid between an opened and closed position.

BRIEF SUMMARY

According to one aspect of the present application, an electrical connector terminal is provided. The connector terminal may comprise a conductive base, a plurality of contact fingers integral with the base and a track integral with the base.

In some embodiments, the electrical connector terminal further may comprise a plurality of tails integral with the base.

In some embodiments, the track may comprise an opening, and the opening faces the plurality of contact fingers.

In some embodiments, the base may comprise a first side facing a first direction and a second side facing a second direction opposite the first direction. The track and the plurality of contact fingers may be formed on the first side with at least a portion of the track and the plurality of contact fingers extending from the base in the first direction. The plurality of tails may be formed on the second side with at least a portion extending in the second direction.

In some embodiments, the track may comprise a first surface parallel to the base and a second surface parallel to the first surface and offset from the first surface in the first direction. The opening of the track may be between the first surface and the second surface. The plurality of contact fingers may comprise contact surfaces at distal portions of the contact fingers. The contact surfaces of the plurality of contact fingers may be spaced from the first surface of the track in the second direction.

In some embodiments, an electronic assembly comprising a first planar substrate and a plurality of connector terminals mounted on the first planar substrate is provided. Tails of the connector terminals may be electrically and mechanically coupled to the substrate.

In some embodiments, the connector terminal may further comprise a tab coupled to the base. The tab may be positioned adjacent the distal ends of at least a portion of the plurality of contact fingers. The tab may be offset from the at least a portion of the plurality of contact fingers such that the tab blocks bending of the contact fingers in the first direction.

In some embodiments, the tab may be integral with the base. In some embodiments, the tab may be separable from and clipped to the base.

In some embodiments, the connector terminal may further comprise a tab coupled to the base. The plurality of contact fingers may have a rest state. The tab may press against the distal ends of at least a portion of the plurality of contact fingers such that distal ends of the contact fingers are offset in the second direction from their rest states, whereby the tab pre-loads the contact fingers.

In some embodiments, at least a first two of the plurality of electrical connector terminals may be positioned with their tracks aligned. At least a second two of the plurality of electrical connector terminals may be positioned with their tracks aligned.

In some embodiments, an electronic system comprising the electronic assembly and a second planar substrate is provided. The second planar substrate may comprise a first edge slidably mounted within the tracks of the first two of the plurality of electrical connector terminals, a second edge slidably mounted within the tracks of the second two of the plurality of electrical connector terminals and a first elongated conductive surface and a second elongated conductive surface between the first edge and the second edge. Contact surfaces on the plurality of contact fingers of the first two of the plurality of electrical connector terminals may contact the first elongated conductive surface. Contact surfaces on the plurality of contact fingers of the second two of the plurality of electrical connector terminals may contact the second elongated conductive surface.

In some embodiments, the electronic system may further comprise first and second rows of the plurality of connector terminals positioned on the first planar substrate along a direction perpendicular to the sliding direction and spaced from one another in the sliding direction.

In some embodiments, the contact fingers of the first row may be offset from the contact fingers of the second row in the direction perpendicular to the sliding direction.

In some embodiments, the distal ends of the plurality of contact fingers of the first row may extend towards the second row. The distal ends of the plurality of contact fingers of the second row may extend towards the first row.

In some embodiments, the base of each of the plurality of connector terminals may further comprise a tab. At least a portion of the tab may be positioned above the plurality of contact fingers in the first direction. The tab may restrain the contact fingers from bending towards the first direction.

According to another aspect of the present invention, an electronic system is provided. The electronic system may comprise a first substrate, a plurality of connector terminals mounted to the first substrate, a plurality of guidance components mounted to the first substrate adjacent the plurality of connector terminals, and a second substrate slidably mounted between the plurality of guidance components. Each of the plurality of connector terminals may comprise a conductive base and a plurality of contact fingers integral with the base. The contact fingers may comprise distal ends. The second substrate may comprise a contact surface thereon. The contact surface may be in contact with the distal ends of the contact fingers of at least one connector terminal of the plurality of connector terminals. The second substrate may be slidable in a sliding direction.

In some embodiments, the plurality of guidance components may comprise a plurality of guide rollers. In some embodiments, a first portion of the plurality of guide rollers may be spaced from a second portion of the plurality of guide rollers in the sliding direction. In some embodiments, at least a first two of the plurality of guide rollers may be spaced from at least a second two of the plurality of guide rollers in a direction perpendicular to the sliding direction.

In some embodiments, the first portion of the plurality of guide rollers may be aligned with each other along the sliding direction. The second portion of the plurality of guide rollers may be aligned with each other along the direction perpendicular to the sliding direction.

In some embodiments, the plurality of guidance components may comprise first and second guide blocks. In some embodiments, the first guide block may be spaced from the plurality of connector terminals in a direction perpendicular to the sliding direction. The second guide block may be spaced from the plurality of connector terminals in a direction perpendicular to the sliding direction and be on an opposite side of the plurality of connector terminals from the first guide block. In some embodiments, the first and second guide blocks may each comprise an opening. The opening of the first guide block may face the plurality of connector terminals. The opening of the second guide block may face the plurality of connector terminals.

According to another aspect of the present application, an apparatus is provided. The apparatus may comprise a plurality of electrical connector terminals. Each of the connector terminals may comprise a plurality of contact fingers and a track elongated in a sliding direction and configured to guide an edge of a bus bar. Each of the plurality of contact fingers may comprise a contact surface thereon. The track may be mechanically coupled to the connector terminal. At least a first of the plurality of electrical connector terminals may be offset from a second of the plurality of electrical connector terminals in the sliding direction. The contact surfaces of the plurality of contact fingers of the first electrical connector terminal may be positioned to make wear paths on a bus bar sliding in the track that are interspersed with and offset, in a direction perpendicular to the sliding direction, from wear paths on the bus bar made by the contact surfaces of the plurality of contact fingers of the second electrical connector terminal.

In some embodiments, each of the plurality of electrical connector terminals may further comprise a conductive base. The plurality of contact fingers may extend from the base in a first direction.

In some embodiments, each of the plurality of electrical connector terminals may further comprise a plurality of tails extending from the base in a second direction, opposite the first direction. The plurality of tails may be configured for electrically and mechanically connecting to a first substrate.

In some embodiments, the track may comprise a plurality of segments. Each segment of the plurality of segments may be integral with the base of the first of the plurality of electrical connector terminals and the second of the plurality of electrical connector terminals.

BRIEF DESCRIPTION OF DRAWINGS

The accompanying drawings are not intended to be drawn to scale. In the drawings, each identical or nearly identical component that is illustrated in various figures is represented by a like numeral. For purposes of clarity, not every component may be labeled in every drawing. In the drawings.

DETAILED DESCRIPTION

Figure 1A:
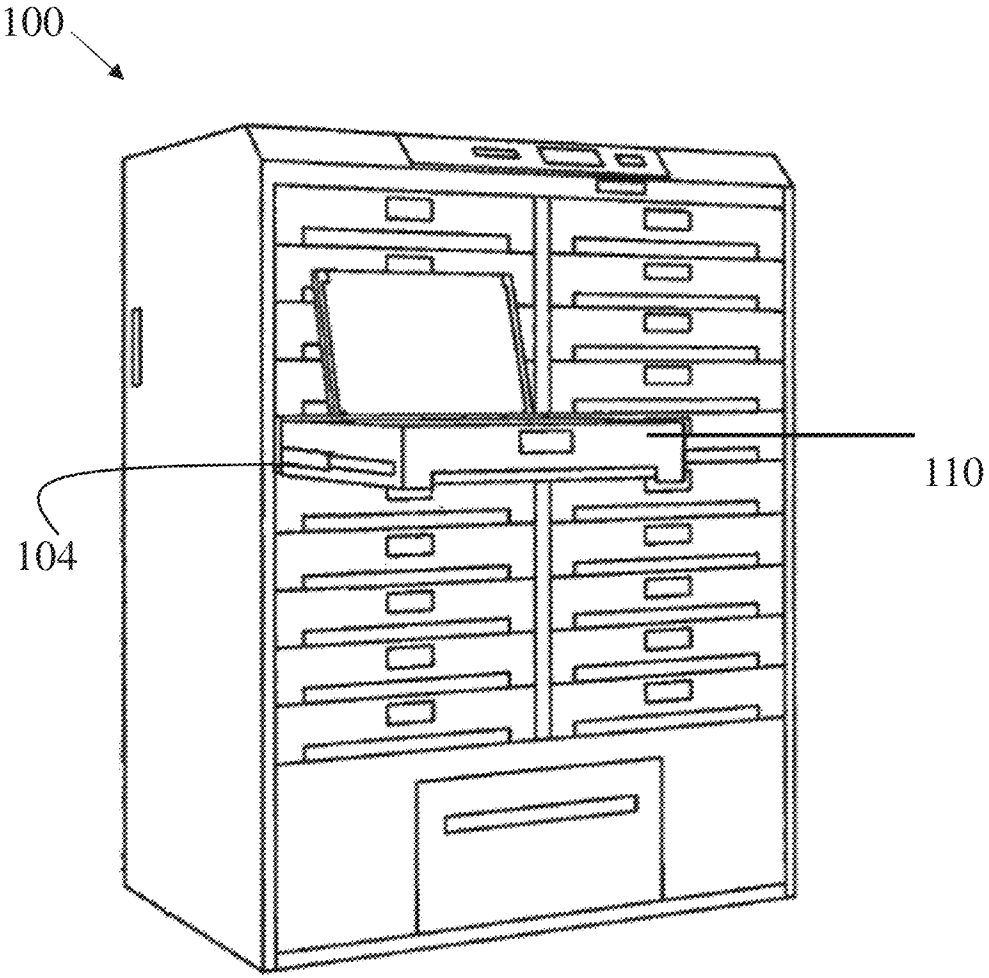
FIG. 1A is a perspective view of an exemplary equipment rack in accordance with some embodiments.

The inventors have recognized design techniques for sliding connectors that can reduce their cost, improve their reliability and/or provide additional flexibility in use. These techniques may be used separately or in any suitable combination.

In some aspects, one or more sliding power connector terminals may be mounted to a printed circuit board or other substrate as part of an electronic assembly. The connector terminal may have sliding contacts that mate to a second substrate with elongated surfaces through which power may be supplied. The second substrate, for example, may be a bus bar in an equipment rack or other electronic system. With this configuration, the electronic assembly may receive power in any of multiple positions relative to the electronic system and may even receive power as it slides in and out of the electronic system, such as occurs when the electronic assembly is in a drawer of the electronic system that may be opened and closed.

Integral with the sliding contacts, a track may be formed to position the second substrate relative to the sliding contacts. Other features of a power connector optionally may be integrally formed with sliding contacts and the tracks. For example tails for attaching the power connector terminal to the printed circuit board or a tab, to preload and/or avoid overstressing the sliding contacts, may be integrally formed with the sliding power contacts. Alternatively, the tab could be a separate part coupled to a base of the terminal.

A power connector terminal as described herein may be inexpensively made from a sheet of metal through known blanking and forming operations. A first portion of the sheet of metal may form a base for the power connector terminal. A second portion of the sheet of metal may be formed into contact fingers, with contact surfaces on them. A further portion of the sheet of metal may be formed into a track, sized to receive the second substrate with elongated surfaces providing power. If a tab, either for preloading or avoiding overstressing the contact fingers, is used, it too may be formed from the sheet of metal. In this way, the connector terminal may be formed in a cost effective way.

Further, in some embodiments, the track may avoid the need for a connector housing, which further reduces cost. The track, for example, may align the contact surfaces with the elongated surfaces on the second substrate. In some embodiments, the track may be formed with lead-ins on one or both ends.

In some embodiments, multiple connector terminals may be used together by mounting them on a printed circuit board or other substrate. One or more pairs of connector terminals may be positioned so that their tracks face each other, spaced to receive the second substrate between them. In other embodiments, instead of, or in addition to, tracks on the connector terminals, connector terminals may be used in an assembly in which a plurality of guidance components are mounted to the first substrate around the connector terminals. The guidance components may be rollers or blocks or have any other suitable shape that positions the second substrate relative to the first substrate such that the contact surface of the connector terminals contact the elongated surfaces on the second substrate.

In another aspect, the sliding contacts may be positioned to reduce wear on the elongated surfaces on the second substrate through which power may be supplied. In some embodiments, contact surfaces may be positioned at distal ends of the contact fingers of one or more connector terminals. Multiple connector terminals may be mounted to the first substrate such that groups of contact fingers are offset from each other in a sliding direction of the second substrate relative to the first substrate. The groups of contact fingers also may be offset from each other in a direction perpendicular to the sliding direction. The groups of contact surfaces that are offset in the sliding direction and a perpendicular direction may contact the same surface of the second substrate, but each contact surface may contact the surface at a different location. Such a configuration may create more wear tracks parallel to the sliding direction than would be created with groups of contact surfaces aligned in the sliding direction, but each wear track will be shallower because it is formed by fewer contact surfaces sliding along that wear track.

In some embodiments, four or more connector terminals may be mounted to a substrate such that the contact surfaces are positioned in rows, which extend perpendicular to a sliding direction. The rows may be parallel to each other. One or more of the contact surfaces within each of two such rows, offset from each other in the sliding direction, may contact the same elongated surfaces on the second substrate. Those two rows may have patterns of contact surfaces offset from each other in the direction perpendicular to the sliding direction such that the contact surfaces within those two rows contact different locations on the elongated surfaces. Such a configuration may create more wear tracks parallel to the sliding direction than would be created with patterns of contact surfaces aligned in the sliding direction, but each wear track will be shallower because it is formed by fewer contact surfaces sliding along that wear track. If there are three or more rows, the contact surfaces in the third, or additional rows, may be offset from the contact surfaces in some or all of the other rows. As a result, contact surfaces on the contact fingers and/or elongated surfaces on the second substrate may last longer, allowing more operational cycles of the drawer of the rack. In yet another aspect, the contact fingers may extend along the sliding direction, with the distal ends of the contact fingers of each row extending towards the distal ends of the contact fingers of a neighboring row. The contact surfaces would thereby be joined closer together to the middle of the configuration of connector terminals, thus extending the effective sliding range of the drawer along its track while maintaining a power connection.

Exemplary embodiments of power connector contact terminals, and electronic assemblies using those contact terminals, are illustrated in the figures.

Referring to FIG. 1A, an equipment rack 100 may contain drawers 110 which may slide in and out of the equipment rack 100 on drawer tracks 104. Tracks 104 are elongated, defining a sliding direction for the subassembly, corresponding to the direction in which the drawer slides along the tracks. Each of the drawers may hold an electronic assembly, such as a PCB on which a processor, memory or other components are mounted. The drawers may slide out to provide access to the assembly. The drawers may serve other functions, such as to organize cables carrying signals to and from the components of the assembly.

Figure 1B:
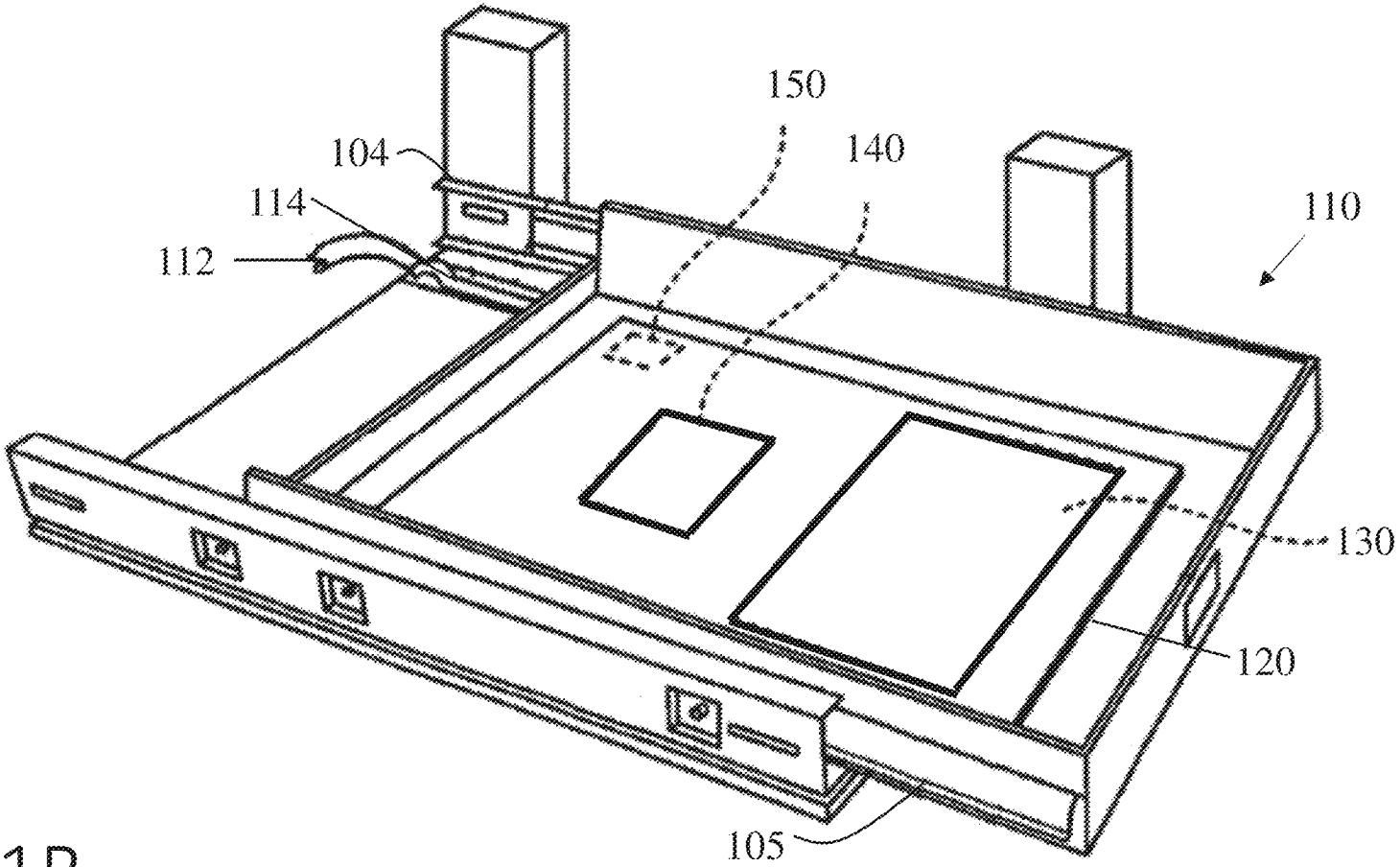
FIG. 1B is a perspective view of an exemplary drawer cut away from the equipment rack of FIG. 1A and which contains electronic equipment in accordance with some embodiments.

FIG. 1B illustrates a drawer 110, cut away from equipment rack 100. Drawer 110 may contain electronic components such as a PCB 120. PCB 120 may comprise a functional circuit 130 and a communication circuit 140. Such circuits may be implemented by attaching integrated circuit devices, such as processors, memory and/or transceivers to PCB 120.

Power may be supplied to the components mounted to PCB 120 through power planes within PCB 120. That power may be supplied to PCB 120 from one or more bus bars 114 within equipment rack 100, which in turn may be connected to a power supply (not shown) either internal or external to equipment rack 100, such as via a cable 112. In the embodiment illustrated, sliding electrical connector terminals are mounted to host PCB 120 in region 150. The connector terminals couple power from bus bars 114 to the PCB 120.

The connector terminals may have mounting tails that engage power planes within PCB 120.

The connector terminals within region 150 may be configured to make electrical contact with bus bar 114. In the embodiment illustrated, contact fingers of the connector terminals within region 150 have contact surfaces at distal ends. The contact fingers provide a spring force, pressing the contact surfaces against surfaces on the bus bar 114. Those surfaces on bus bar 114 may be elongated in the sliding direction. As a result, the contact fingers may slide along surfaces on bus bar 114 as drawer 110 is opened or closed. Such a configuration enables power to be supplied from bus bar 114 to PCB 120 while drawer 110 is opened, closed or at any intermediate location.

Bus bar 114 may have any desired configuration. In some embodiments, bus bar 114 may have two elongated surfaces configured to mate with connector terminals in region 150. Such a configuration, with two electrically separate elongated surfaces, may be used to provide a supply and return path at a single voltage level, such as 12 Volts. Alternatively, two elongated surfaces may provide two supply paths at two different voltages, such as +12V and −12V. However, any suitable voltage level may be supplied on each of the elongated surfaces. Moreover, any suitable number of elongated surfaces may be present. Embodiments are illustrated in which there are two elongated surfaces, each of which aligns with one or more sets of contact fingers on connector terminals within region 150. In other embodiments, three or more elongated surfaces may be provided on bus bar 114, with groups of contact fingers of connector terminals aligned with each elongated surface.

Bus bar 114 may be implemented in any suitable way. In some embodiments, bus bar 114 may be implemented as a power supply printed circuit board ("PCB"). In the embodiment of FIG. 1B, bus bar 114 is elongated in a direction parallel to and runs alongside the drawer tracks 104. Elongated surfaces on bus bar 114 may be formed as conductive pads 116 and 118. The elongated surfaces 116 and 118 may be conductive and serve as contact regions of the bus bar 114. Contact fingers of connector terminals within region 150 may make mechanical and electrical contact to these contact regions. In the orientation shown in FIG. 1B, region 150 is located on a lower surface of PCB 120. Bus bar 114 is mounted below PCB 120, with the contact regions facing PCB 120.

Figure 2:
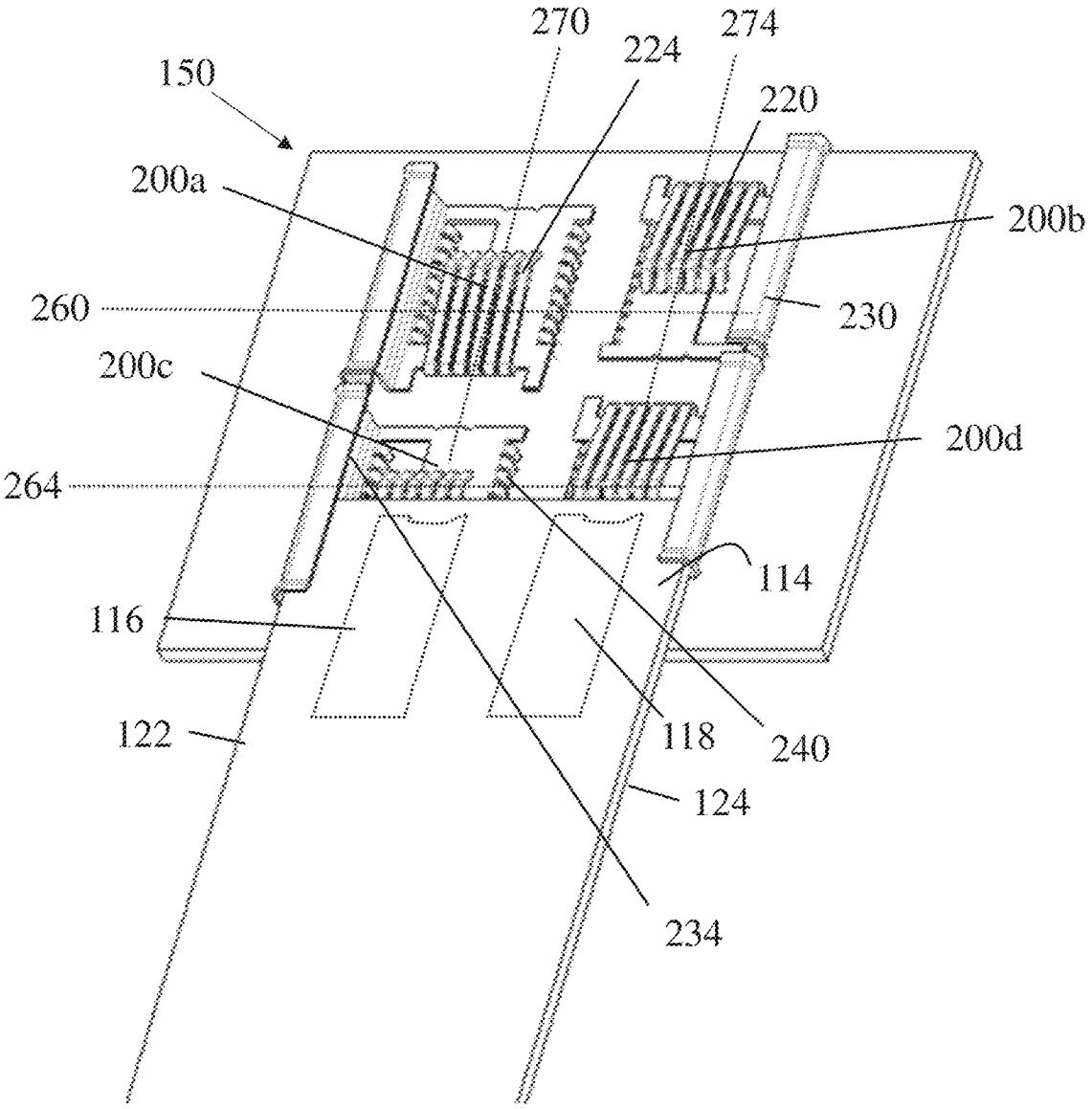
FIG. 2 is a perspective view of an exemplary embodiment of a portion of a sliding electronic assembly having electrical connector terminals with integrated guidance.

FIG. 2 shows the bottom view of a portion of the lower surface of PCB 120 including region 150 where connector terminals are mounted. Bus bar 114 has a first edge 122 and a second edge 124, with contact regions between these edges. In the embodiment illustrated, two contact regions 116 and 118 are illustrated. The contact regions are on the surface of bus bar 114 facing region 150. In the view of FIG. 2, the contact regions are on the surface of bus bar 114 that is not visible such that the contact regions are shown in phantom. Contact regions 116 and 118 are shown extending along only a portion of the length of bus bar 114. That depiction is for simplicity of illustration as, in some embodiments, contact regions will extend over the entire length of bus bar 114 that will be adjacent to region 150 when PCB 120 slides relative to bus bar 114. However, it is not a requirement and contact regions 116 and 118, which are connected to voltage supplies delivering power through bus bar 114, may be present on bus bar 114 in a discrete location or locations in which connector terminals will engage the contact regions 116 and 118.

In the embodiment illustrated in FIG. 2, region 150 comprises multiple connector terminals 200*a-d*. In the embodiment illustrated in FIG. 2, each of the connector terminals 200*a-d* has the same configuration, with connector terminals 200*a* and 200*c* being mounted in a position rotated 180 degrees with respect to connector terminals 200*b* and 200*d*. Accordingly, any of connector terminals 200*a-d* may be represented by connector terminal 200 in FIG. 3. Connector terminal 200 may comprise contact fingers 220 and tails 240, as well as a track 230. The contact fingers 220 may further comprise contact surfaces 224.

The tails 240 may be configured for mounting to the host PCB 120. In this example, the tails 240 are configured to be press fit into holes in the host PCB 120. Alternatively, the tails 240 may be electrically and mechanically coupled to the host PCB 120 in any other way. The host PCB 120 may contain conductive traces connecting the tails 240 to a portion of the communication circuit 140 and/or the functional circuit 130.

The tracks 230 may be configured to receive the bus bar 114 in a sliding direction. Each track 230 may comprise an opening 234, and each opening 234 may face the contact fingers 220. The tracks 230 may be aligned to form segments of longer tracks.

As shown in FIG. 2, the connector terminal may be mounted so that the tracks 230 of the connector terminals are positioned to capture bus bar 114. As shown, tracks 230 of connector terminals 200*a* and 200*c* face the tracks 230 to connector terminals 200*b* and 200*d*. Further, the tracks 230 of terminals 200*a* and 200*c* are aligned in the sliding direction, as are the tracks 230 of terminals 200*b* and 200*d*. In this way, the tracks 230 of terminals 200*a* and 200*c* combine to form a track in which edge 122 of bus bar 114 may be retained. Likewise, tracks 230 of connector terminals 200*b* and 200*d* are aligned in the sliding direction to retain edge 124. The openings 234 in the tracks 230 of connector terminals 200*a-d* may be wider than the thickness of bus bar 114 such that bus bar 114 may slide within those tracks 230.

FIG. 2 shows that, within region 150, the connector terminals 200*a-d* are mounted in an array, enabling multiple points of contact to the same conductive surface on bus bar 114 and to multiple conductive surfaces that are electrically separated. The connector terminals 200, for example, may be positioned in first column 270 and second column 274 extending along the sliding direction. The tracks 230 of the first column 270 may be aligned with each other along the sliding direction, and the tracks 230 of the second column 274 may be aligned with each other along the sliding direction such that the openings 234 of the tracks 230 of the first column 270 may be configured to receive the first edge of the bus bar 114 and the openings 234 of the tracks 230 of the second column 274 may be configured to receive the second edge of the bus bar 114. The contact surfaces 224 of the contact fingers 220 may be configured to contact the conductive surfaces of the bus bar 114. As the drawer 110 slides along the drawer tracks 104, the contact surfaces 224 of the contact fingers 220 may thereby slide along the conductive surfaces of the bus bar 114. Sliding of the contact fingers 220 along the conductive surfaces of the bus bar 114, concurrent with the tails 240 being mounted to the host PCB 120, may establish an electrical connection between components of the host PCB 120 and the bus bar 114.

The region 150 may further comprise a first row 260 and a second row 264 of connector terminals which may extend along a direction perpendicular to the sliding direction. In the illustrated embodiment, in which the same connector terminals are used, there may be two connector terminals in each row, oriented to provide a track at each end of the row.

In other embodiments, connector terminals within the same row may have different configurations, with, for example, some connector terminals having integral tracks and some without tracks. In such a configuration, each row may have more than two connector terminals. The contact fingers 220 of the terminals within each row may extend in the same direction along the sliding direction, or they may extend in opposite directions along the sliding direction, as is illustrated in the configuration of FIG. 2. The contact surfaces 224 of the contact fingers 220 may be aligned along the first row 260, even if the contact fingers 220 of adjacent terminals 200*a* and 200*b* extend in opposite directions. Similarly, the terminals within each column may extend in the same direction along the sliding direction, as is illustrated in the configuration of FIG. 2, or they may extend in opposite directions along the sliding direction.

The inventors have recognized and appreciated that position and orientation of the contact fingers may impact functionality of a system using the connector terminals 200*a-d*. The travel distance of the region 150 along the bus bar 114 during which the power connection is established, for example, may be increased if the contact fingers 220 of the first row 260 extend towards the second row 264, and the contact fingers 220 of the second row 264 extend towards the first row 260. Additionally, wear on the contact surfaces 116 and 118 may be reduced for a longer lifetime if the contact fingers 220 of the first row 260 are offset from the contact fingers of the second row 264 in the direction perpendicular to the sliding direction.

Figure 3:
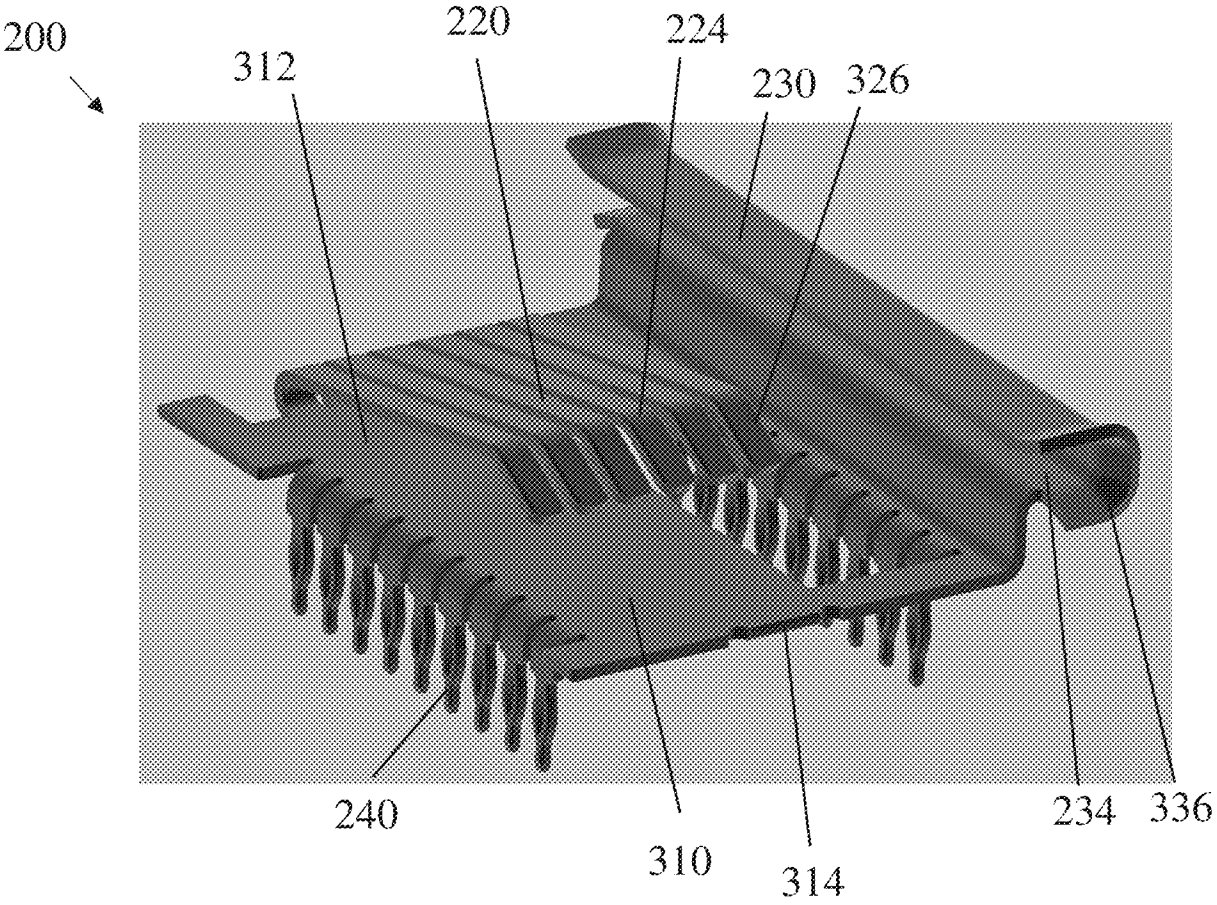
FIG. 3 is a perspective view of an exemplary embodiment of an electrical connector terminal with integrated guidance.

Turning to FIG. 3, an electrical connector terminal 200 (one of the terminals 200*a-d* as illustrated in FIG. 2) is illustrated. Connector terminal 200 may be formed from an electrically conductive material that is suitably springy to form electrical contacts. Suitable materials include copper alloys or other metal alloys known in the art of electrical connector manufacture. In accordance with some embodiments, connector terminal 200 may be manufactured from a sheet of metal that is blanked and formed into the desired configuration. Terminal 200 may comprise a base 310, with contact fingers 220 and tails 240 extending from base 310. Contact fingers 220 may further comprise contact surfaces 224 at distal ends 326. Additionally, a track 230 may be formed from the same sheet of metal such that all of these elements may be integral with base 310. The track 230 may comprise an opening 234 with a lead-in portion 336 at one or multiple ends of the track 230. The lead-in portion 336 may flare out or otherwise widen the opening 234 to facilitate insertion of the bus bar 114 into the opening 234 of the track 230. The lead-in portion 336 may be formed from the same sheet of metal as the track 230. In the illustrated example, the opening 234 continuously flares outwardly at the lead-in portion 336 as the track 230 reaches an end.

The electrical connector terminal 200 may be manufactured from a single sheet of metal. For example, portions of the base 310 may be stamped or bent or otherwise manipulated into contact fingers 220, tails 240, the track 230 or other features. Thus, various features may be formed as an integral part and without needing a housing, resulting in a reduced cost.

The base 310 may comprise a first side 312 which may face a first direction and a second side 314 which may face a second direction opposite the first direction. Track 230 and the contact fingers 220 may be formed on the first side 312 with at least a portion of contact fingers 220 and track 230 extending in the first direction, and tails 240 may be formed on second side 314 with at least a portion extending in the second direction. In this way, connector terminal 200 may be mounted to a PCB with the second side adjacent the PCB and the first side facing a bus bar that can be adjacent the surface of the printed circuit board. The track 230 may comprise a first surface parallel to the base and a second surface parallel to the first surface and offset from the first surface in the first direction. The opening 234 may be between the first and second surfaces. Contact fingers 220 may be spaced from the opening 234 of the track in a direction parallel to the surface of the printed circuit board such that, when an edge of the bus bar is in an opening 234 conductive surfaces on the bus bar will be aligned with contact fingers.

Other features alternatively or additionally may be incorporated in some or all of the connector terminals in an electronic assembly. Those features may also be integrally formed with the base or may, in some embodiments, be incorporated in other ways.

Figure 4A:
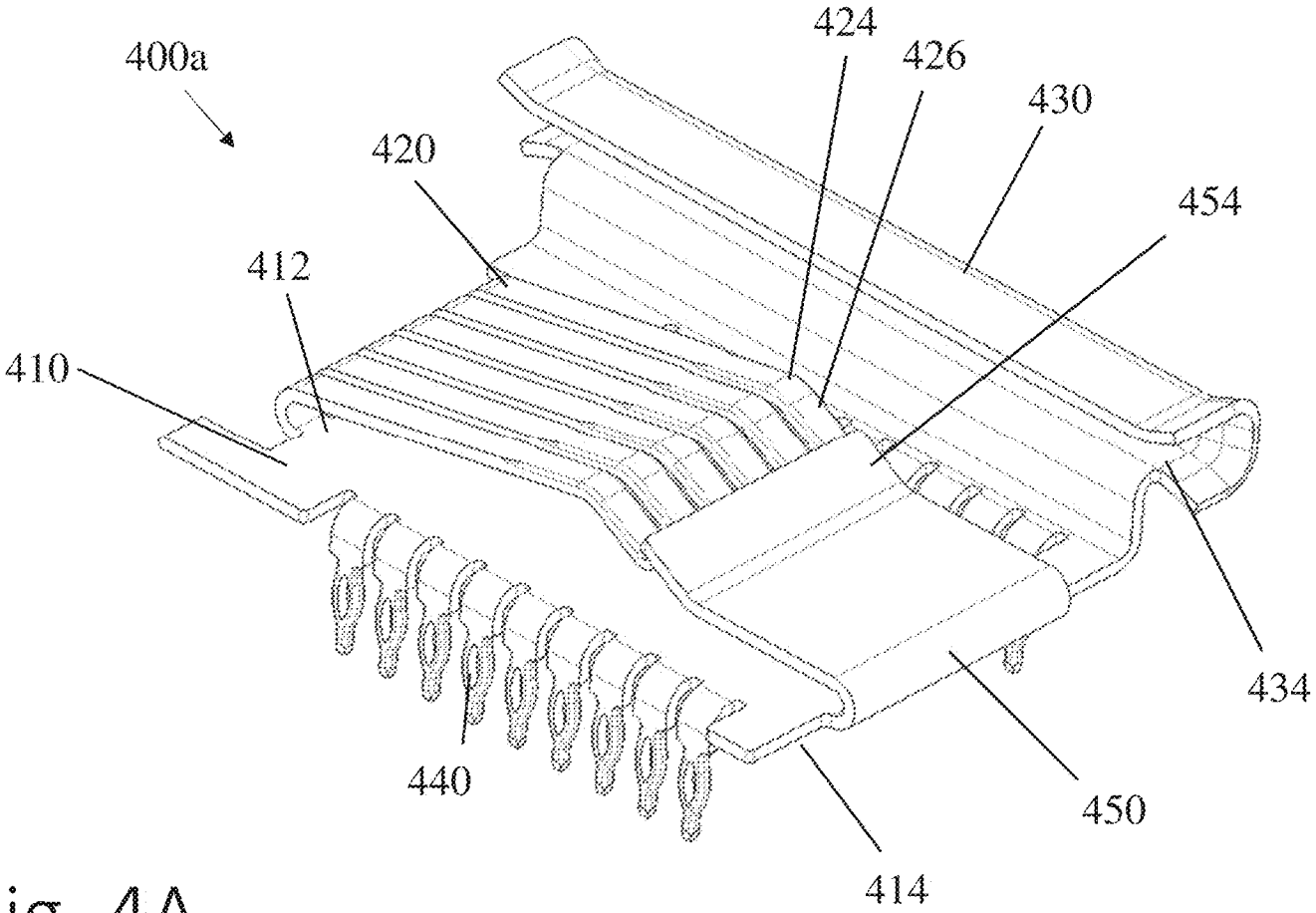
FIG. 4A is a perspective view of an alternative embodiment of an electrical connector terminal in which spring fingers are preloaded and/or protected from overstress by integrally formed tabs.
Figure 4B:
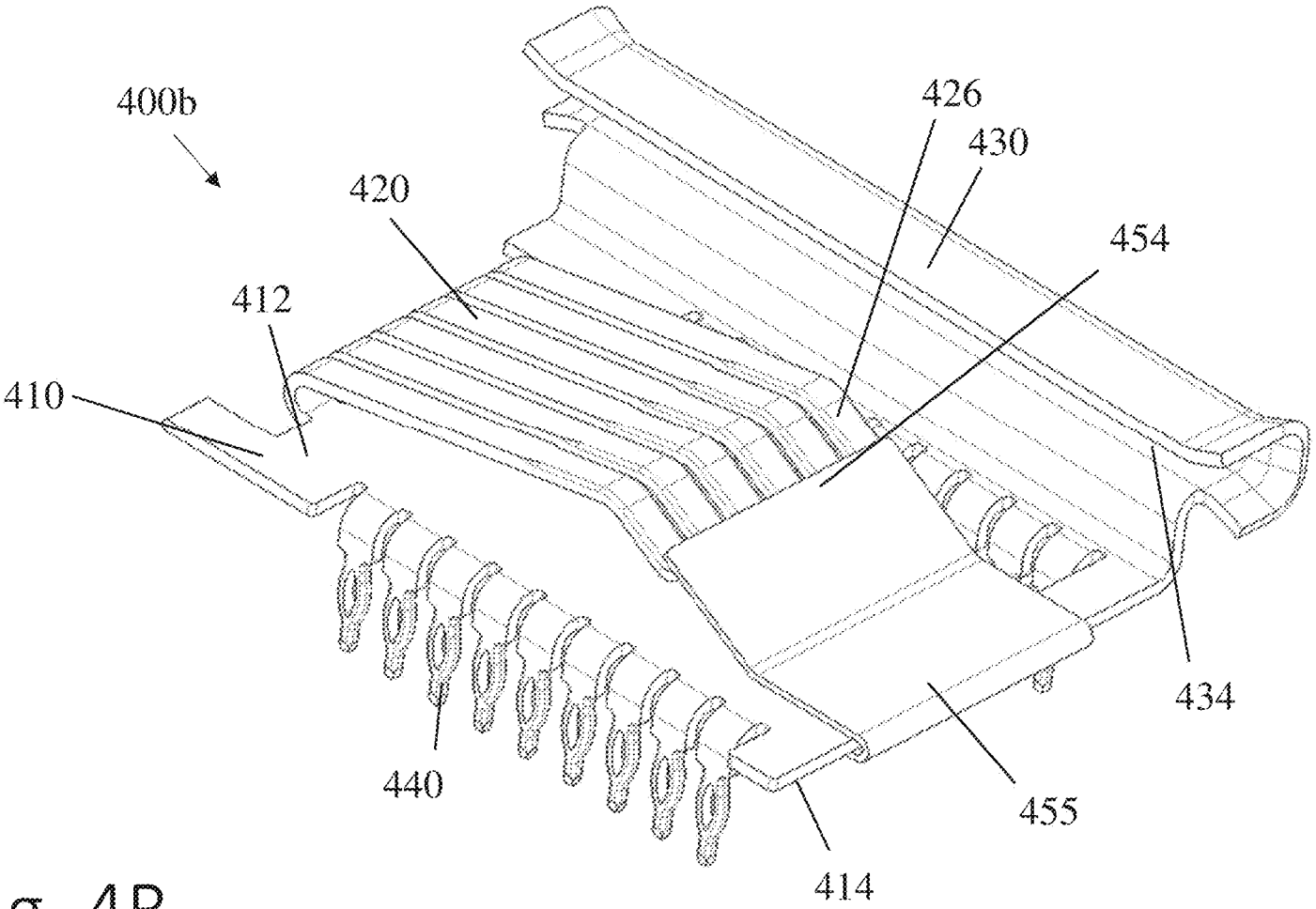
FIG. 4B is a perspective view of an alternative embodiment of an electrical connector terminal in which spring fingers are preloaded and/or protected from overstress by tabs coupled to the terminal.

FIGS. 4A-B show alternative embodiments of the connector terminal 200 with integrated or attached tabs which may pre-load or prevent over-stressing of contact fingers. Like connector terminal 200, each of the connector terminals 400*a-d* has an integral base 410, contact fingers 420 having contact surfaces 424 at distal ends 426 and a track 430. The base 410 may have a first side 412 facing a first direction and a second side 414 facing a second direction opposite the first direction. Connector terminals 400*a-b* may further comprise a tab. The contact fingers 420 and at least a portion of the tab may be located on the first side 412 of the base 410. In FIG. 4A, tab 450 is illustrated as integral with the base 410 of the connector terminal 400*a*. The tab 450 may be formed out of the same sheet as the other features of the terminal 400*a*. For example, the tab 450 may be formed by folding an extended portion of the base 410 over on itself towards the contact fingers 420. Alternatively to being formed integral with the base 410, the tab 455 is illustrated in FIG. 4B as being formed separately and then attached to the connector terminal 400*b*. As illustrated, tab 455 is formed from a sheet of metal that has a portion folded over on itself. When the base 410 is inserted into the folded portion, the folded portion will retain tab 455 to the base 410, as with a clip.

In either case, a portion 454 of tab 450 or tab 455 may be positioned adjacent distal ends 426 of contact fingers 420. Portion 454 is shown offset from the contact fingers 420 in the first direction such that portion 454 blocks bending of the contact fingers 420 in the first direction. In such a configuration, tab 450 or tab 455 may prevent damage to the contact fingers 420.

Alternatively or additionally, tab 450 or tab 455 may preload the contact fingers 420. Contact fingers 420 are spring contacts. They may extend sufficiently above the base 410 that, when a bus bar (such as the bus bar 114) is inserted into a track 430, the bus bar will press on the contact fingers 420, and the contact fingers 420 will be deflected towards base 410. This deflection of the contact fingers 420 will generate a spring force on the surface of the bus bar. This force should be sufficiently large to ensure a reliable electrical contact between the contact fingers 420 and the surface of the bus bar. Tab 450 or tab 455 may increase this contact force by preloading the contact fingers 420. Preloading may result because each of the contact fingers 420 has a rest state—a position that it will spring into when no force is acting on it. The force generated by each contact finger 420 may depend on the amount the contact finger 420 is deflected from its rest state.

Contact fingers 420 may be bent such that their rest states are beyond the track 430 in the first direction. Tab 450 or tab 455 will hold the distal ends 426 sufficiently below track 430 that, when a bus bar (such as bus bar 114) is inserted into track 430, it does not strike the distal ends 426 of the contact fingers 420, which might damage the connector terminal 400*a* or 400*b* or prevent contact between the contact terminals 400*a* or 400*b* and the bus bar. When the contact fingers 420 are deflected to contact a surface of a bus bar in track 430, the amount the contact fingers 420 are deflected may equal the amount by which the rest state of the contact surfaces 424 extend above the track. When tab 450 or tab 455 is used, contact fingers 420 may be bent such that the amount of deflection from the rest state is much larger than would be possible if the distal ends 426 of the contact fingers 420 had to be below track 430. Accordingly, increased spring force may be generated with tab 450 or 455. The inventors have recognized and appreciated that the tabs 450 and 455 prevent overstressing of the contact fingers 420 and increase the spring force with which the contact fingers 420 can be applied to the bus bar 114.

Figure 5A:
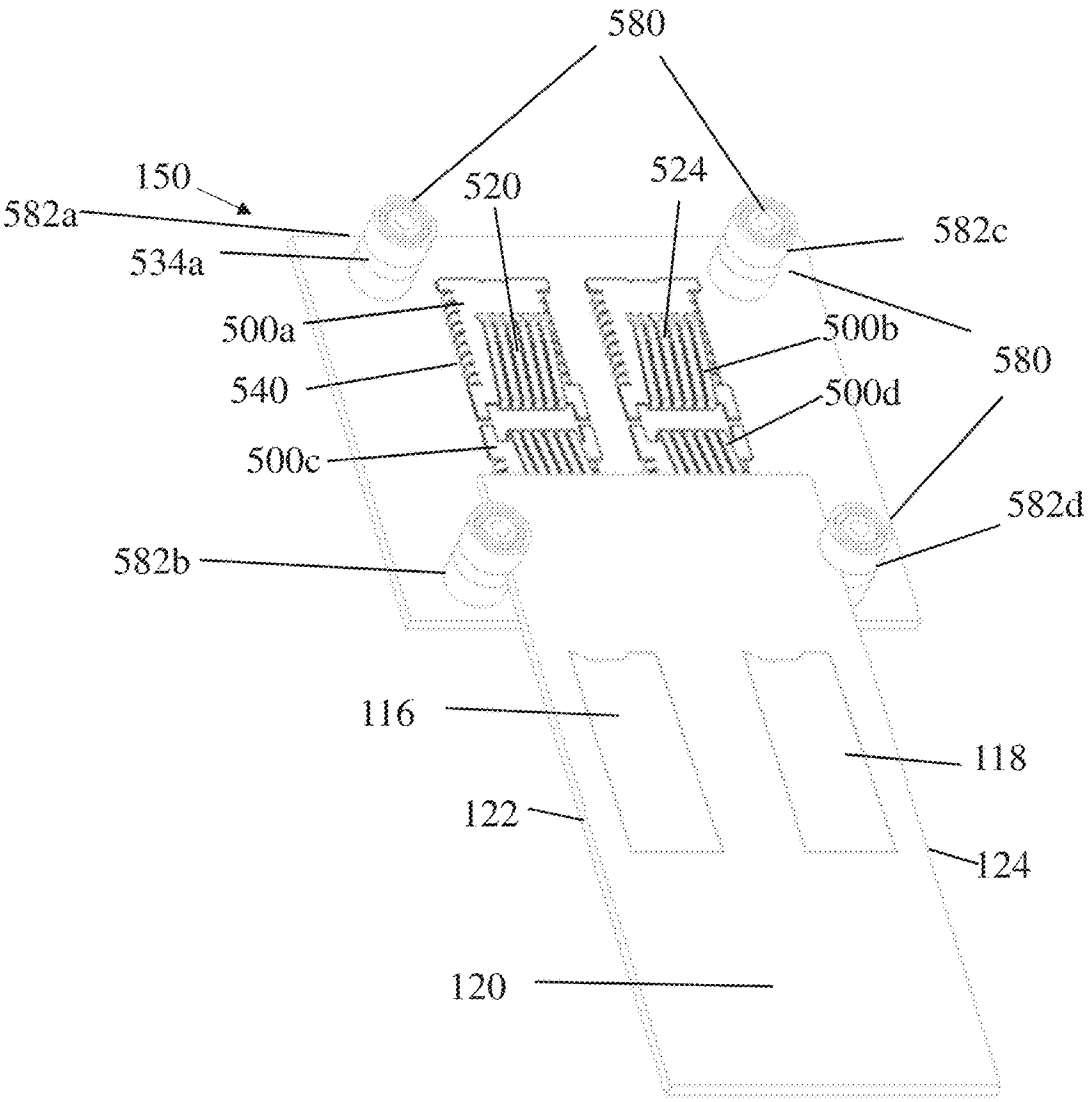
FIG. 5A is a perspective view of an exemplary embodiment of a portion of a sliding electronic assembly in which guidance components are mounted to a printed circuit board to which a sliding electrical connector terminals are mounted.
Figure 5B:
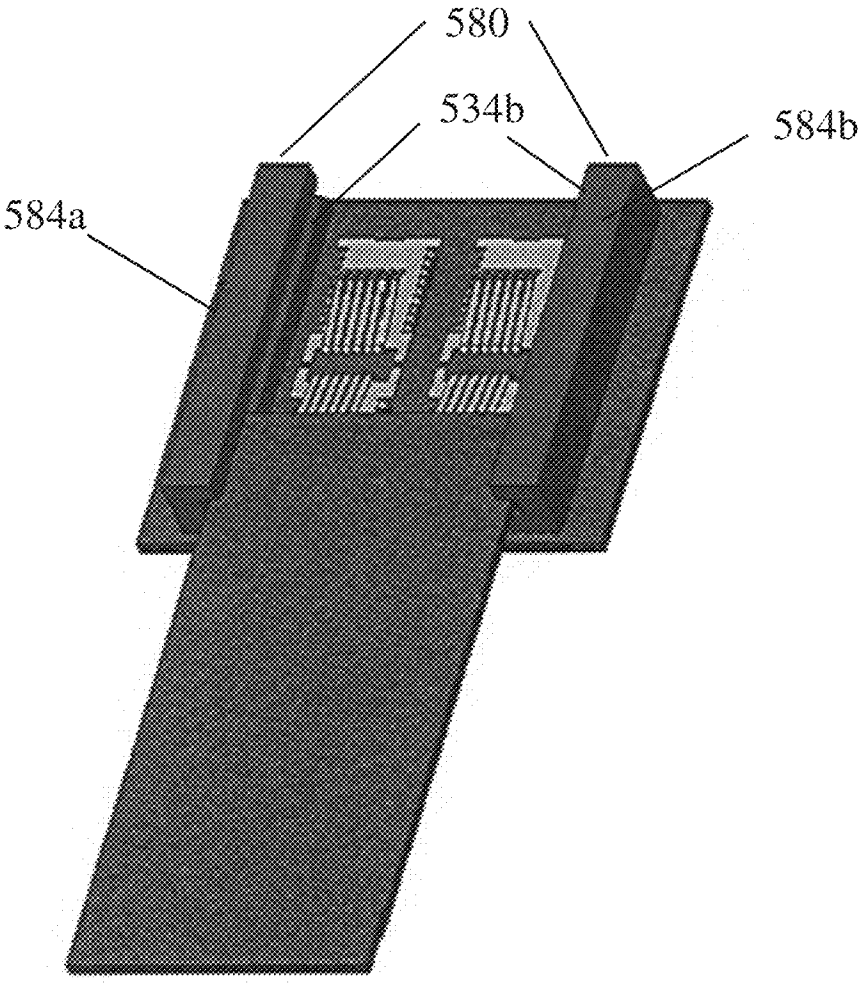
FIG. 5B is a perspective view of an alternative embodiment of a sliding electronic assembly in which guidance components are mounted to a printed circuit board to which a sliding connector terminals are mounted.

In the embodiments illustrated in FIGS. 2-3 and 4A-B, tracks integral with the connector terminals include lead-ins that facilitate insertion of a bus bar into the tracks, without requiring a connector housing. Those lead-ins may be formed as part of the same blanking and forming operations used to form other portions of the connector terminal. Alternatively or additionally, other components not necessarily integral with the connector terminals may provide guidance for aligning a bus bar with the contact fingers. Referring now to FIGS. 5A-B, an alternative embodiment of sliding electrical connector terminals in region 150 may comprise connector terminals 500*a-d*. Like the connector terminals 200*a-d* described in previous examples, the connector terminals 500*a-d* may comprise contact tails 540 configured for mounting to the host PCB 120 and contact fingers 520 having contact surfaces 524. However, the connector terminals 500*a-d* may not comprise tracks. In some embodiments, guidance components 580 may be positioned adjacent to the connector terminals 500*a-d* instead of tracks. The guidance components 580 may comprise multiple components. Although tracks are not illustrated in FIGS. 5A and 5B, any combination of tracks and/or guidance components 580 may be used to position the bus bar 114.

In FIG. 5A, the guidance components 580 are illustrated as guide rollers 582*a-d*. The guide rollers 582*a-d* may be attached to the host PCB 120. The guide rollers 582*a-d*, for example, may be screwed, fastened or otherwise mounted to the host PCB 120. Each guide roller 582*a-d* may comprise a track 534 which may lie along the perimeter of the guide roller 582*a-d*. The contact fingers 520 may be spaced from the tracks 534 of the guide rollers 582*a-d* in a second direction.

The guide rollers 582*a-d* may be spaced to receive the bus bar 114 between them. A first portion of guide rollers 582*a-b* may be aligned with each other along the sliding direction, and a second portion of guide rollers 582*c-d* may be aligned with each other along the sliding direction and spaced from the first portion of guide rollers in the direction perpendicular to the sliding direction. Guide rollers 582*a-d* may include tracks or other structures that position the bus bar at a defined distance relative to a surface or the PCB. In such a configuration, the tracks 534 of the first portion of guide rollers 582*a-b* may be configured to receive the first edge 122 of the bus bar 114. Similarly, the tracks 534 of the second portion of guide rollers 582*c-d* may be configured to receive the second edge 124 of the bus bar 114.

The guidance components 580 may have any suitable form that positions a bus bar in one or more dimensions with respect to connector terminals, yet allows relative sliding motion between the bus bar and the contact terminals. Accordingly, it is not a requirement that guide rollers 582*a-d* include moving parts. They may be implemented, for example, as posts with smooth surfaces that allow sliding of the edge of the bus bar across the surface. Alternatively, in FIG. 5B, the guidance components 580 are illustrated as first and second guide blocks 584*a-b*. The guide blocks 584*a-b* may be supported by the host PCB 120. The guide blocks 584*a-b* may be screwed, fastened or otherwise mounted to the host PCB 120. Each of the guide blocks 584*a-b* may comprise an opening 535*b*. The openings 534*b* of the guide blocks 584*a-b* may face the contact fingers 520. The contact fingers 520 may be spaced from the openings 534*b* of the guide blocks 584*a-b* in the second direction.

The guide blocks 584*a-b* may be configured to mate with the bus bar 114. The opening 534*b* of the first guide block 584*a* may be configured to receive the first edge 122 of the bus bar 114. Similarly, the opening 534*b* of the second guide block 584*b* may be configured to receive the second edge 124 of the bus bar 114.

In the embodiments illustrated in FIGS. 2-3, 4A-B and 5A-B, connector terminals 200, 400*a-b* or 500 disposed on region 150 may be configured such that the contact fingers of adjacent rows or columns may be offset with respect to one another, or the contact fingers of each row or column may extend towards an adjacent row or column. Such configurations of offset contact fingers and contact fingers which extend towards adjacent rows are illustrated in FIGS. 6A-B.

Figure 6A:
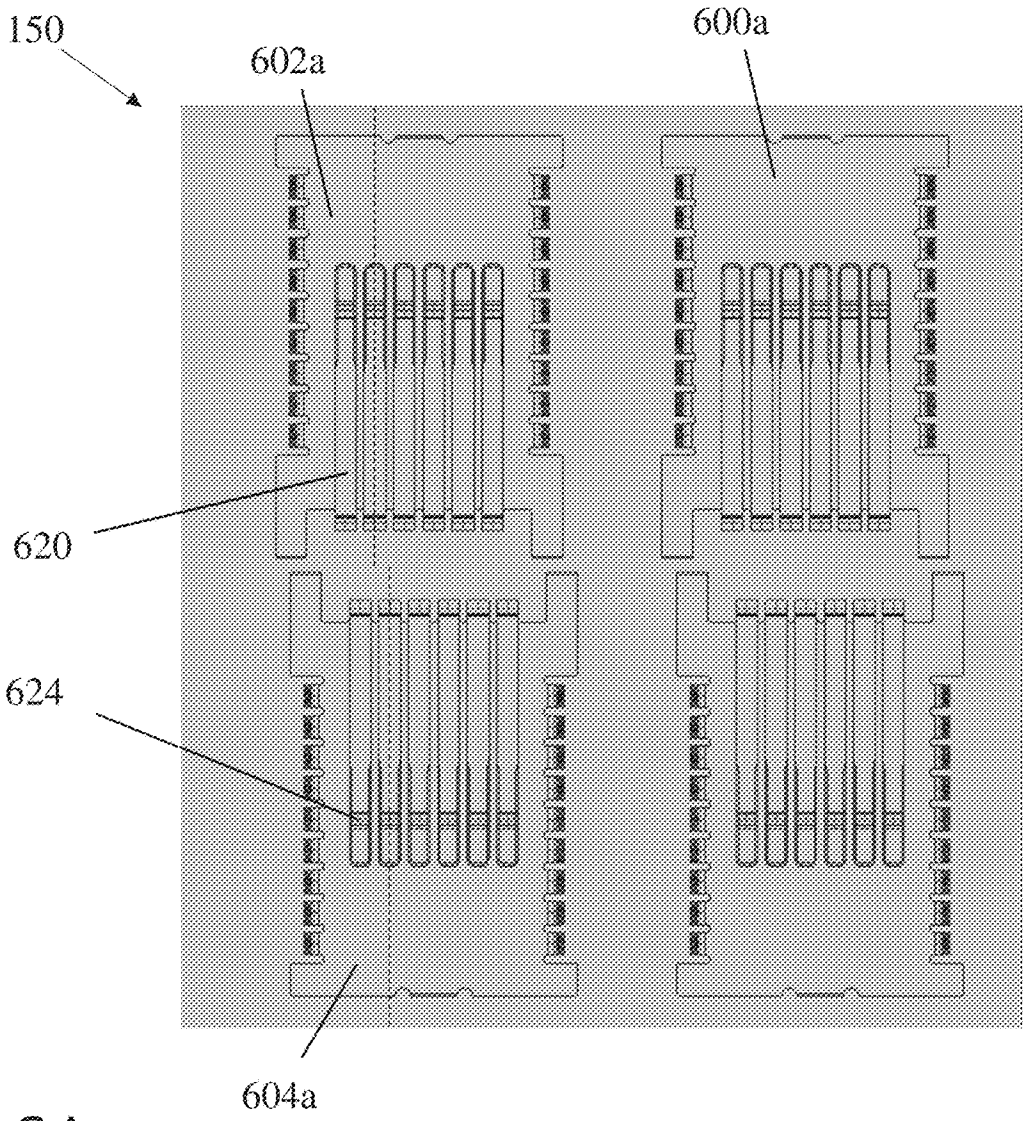
FIG. 6A is a top view of an alternative embodiment of a portion of a sliding electronic assembly having electrical connector terminals with offset contact fingers.

In FIG. 6A, an alternative embodiment of region 150 is illustrated, in which connector terminals 600*a* have offset contact surfaces 624. The connector terminals 600*a* each comprise a base, contact fingers having contact surfaces 624, tails, tracks and/or other components described in connection with connector terminals 200, 400*a-b* and 500 of FIGS. 2-3, 4A-B and 5A-B respectively. In the illustrated embodiment, connector terminals 602*a* and 604*a* are offset in the sliding direction. Some or all of the connector terminals 600*a* may comprise mechanically coupled tracks (such as tracks 230 illustrated in FIGS. 2-3) or they may not comprise tracks (such as illustrated in FIGS. 5A-B). Although connector terminals 600*a* do not have tracks in the illustrated embodiment, guidance components (such as guidance components 580 in FIGS. 5A-B) may be incorporated to receive a bus bar (such as bus bar 114).

The contact surfaces 624 may be positioned to slide along a wear path on the bus bar as it slides with respect to region 150. Such sliding may occur when drawer 110 (FIG. 1B) is slid in or out such that bus bar 114 slides with respect to contact region 150 in the tracks, or alternatively in the guidance components. Contact surfaces 624 on contact fingers 620 of connector terminals 602*a* and 604*a* may be offset in a direction perpendicular to the sliding direction, such that wear paths on the bus bar of those contact fingers are suitably offset in the direction perpendicular to the sliding direction. In the illustrated embodiment, connector terminals 602*a* and 604*a* are shifted by one-half a width of the contact fingers 620 in the direction perpendicular to the sliding direction. However, the connector terminals 602*a* and 604*a* may alternatively be shifted by an amount greater or less than that which is illustrated. It should also be appreciated that the connector terminals 602*a* and 604*a* may be aligned in the sliding direction, but may be configured such that the contact fingers 620 of the connector terminals 602*a* and 604*a* are offset in the direction perpendicular to the sliding direction by any suitable amount. For example, the contact fingers 620 may be disposed in offset positions within the connector terminals 602*a* and 604*a*. Further, the contact fingers 620 may be aligned, but the contact surfaces 624 may be offset in the direction perpendicular to the sliding direction. It should further be appreciated that more connector terminals may be adjacent connector terminals 602*a* and/or 604*a* in the sliding direction, and that within groups of more than two connector terminals, contact surfaces of one connector terminal may be offset with respect to some or all of the other connector terminals in the direction perpendicular to the sliding direction. The inventors have recognized and appreciated that a configuration having offset connector terminals, contact fingers and/or contact surfaces may create more wear tracks parallel to the sliding direction than would be created with groups of contact surfaces aligned in the sliding direction, but each wear track will be shallower because it is formed by fewer contact surfaces sliding along that wear track. Shallower wear tracks may result in a longer device lifetime and/or more reliable operation of the device.

Figure 6B:
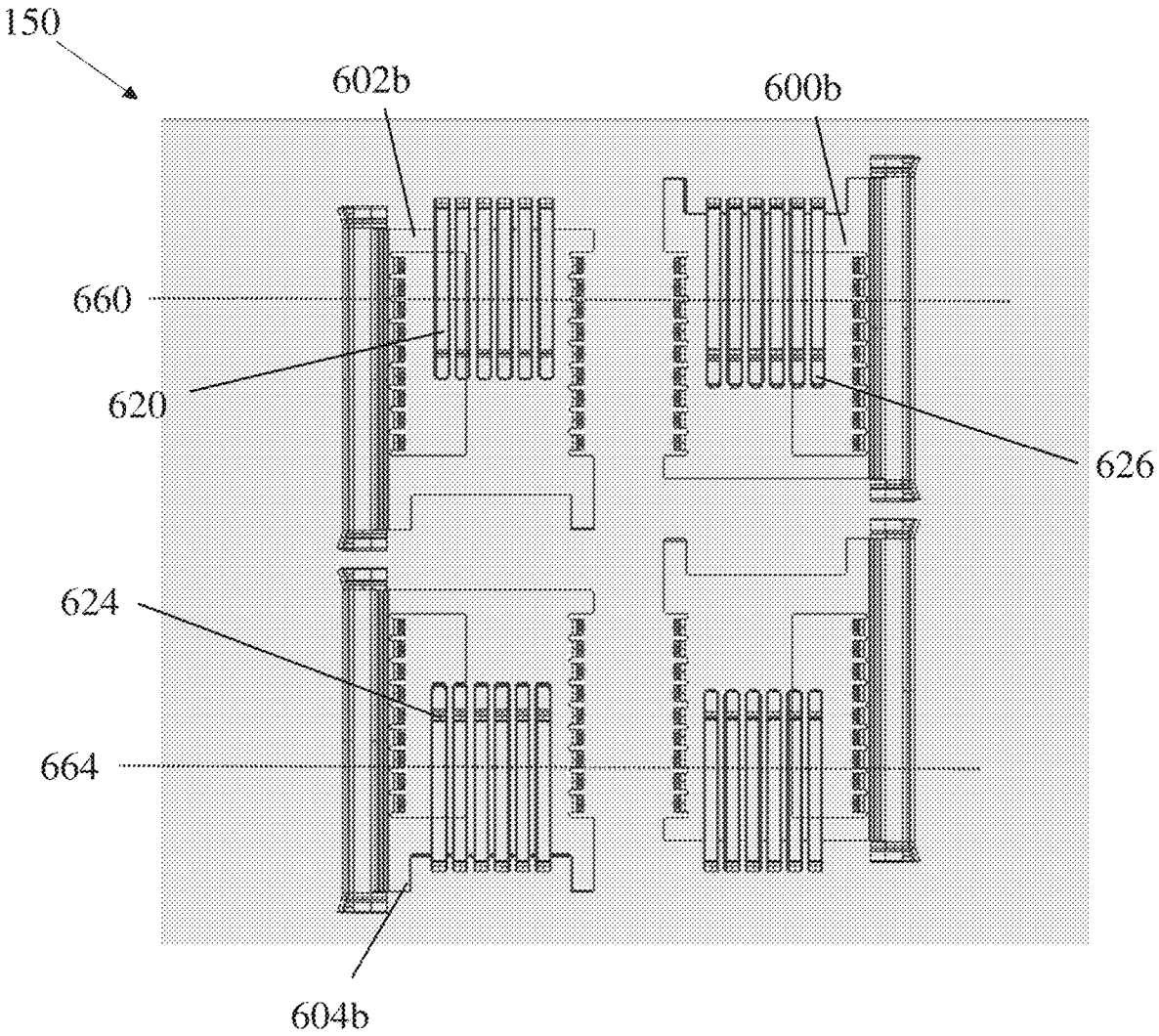
FIG. 6B is a top view of an alternative embodiment of a portion of a sliding electronic assembly having electrical connector terminals with contact fingers extending towards adjacent connector terminals.

In FIG. 6B, an alternative embodiment of region 150 is illustrated, such that contact fingers in a connector terminal extend towards an adjacent connector terminal. The connector terminals 600*b* each comprise a base, contact fingers having contact surfaces 624, tails, tracks and/or other components described in connection with connector terminals 200, 400*a-b* and 500 of FIGS. 2-3, 4A-B and 5A-B respectively. Some or all of the connector terminals 600*b* may comprise mechanically coupled tracks (such as tracks 230 illustrated in FIGS. 2-3) or they may not comprise tracks (such as illustrated in FIGS. 5A-B). Although connector terminals 600*b* comprise tracks in the illustrated embodiment, guidance components (such as guidance components 580 in FIGS. 5A-B) may be incorporated in addition to or in place of the tracks to receive a bus bar (such as bus bar 114).

In the illustrated embodiment, distal ends 626 of contact fingers 620 of connector terminal 602*b* extend towards connector terminal 604*b*, and distal ends 626 of contact fingers 620 of connector terminal 604*b* extend towards connector 602*b*. Further, a first row 660 of connector terminals including connector terminal 602*b* and a second row 664 of connector terminals including connector terminal 604*b* each extend in a direction perpendicular to the sliding direction. Distal ends 626 of contact fingers 624 of connector terminals 600*b* of the first row 660 extend towards the second row 664, and distal ends 626 of contact fingers 624 of connector terminals 600*b* of the second row 664 extend towards the first row 660. However, it should be appreciated that individual connector terminals such as 602*b* or 604*b* or groups of connector terminals may be configured with contact fingers extending towards an adjacent row.

The inventors have recognized and appreciated that the travel distance of the region 150 along the bus bar 114 during which the power connection is established may be increased if the contact fingers of a connector terminal or a row of connector terminals extend towards an adjacent connector terminal or row of connector terminals. If both rows in the configuration of FIG. 6B have contact fingers pointing towards the other, travel distance may be further increased.

Although the illustrated embodiment shows only two rows of connector terminals, it should be appreciated that more than two rows may be present. In an embodiment in which two rows are present, contact fingers in each of the two rows may extend towards the other row. In embodiments in which more than two rows are present, contact fingers in the two outermost rows may extend towards the center of region 150.

Having thus described several embodiments, it is to be appreciated various alterations, modifications, and improvements may readily occur to those skilled in the art. Such alterations, modifications, and improvements are intended to be within the spirit and scope of the invention. Accordingly, the foregoing description and drawings are by way of example only.

Various changes may be made to the illustrative structures shown and described herein. For example, conductive surfaces on a bus bars may be continuous over the range of locations at which contact surfaces of the connector terminals contact the bus bar. However, it is not a requirement that the conductive surfaces be continuous over the range of relative motion of the bus bar and the connector terminals. Conductive surfaces may be provided at one or more discrete locations on the surface of the bus bar such that power is supplied to an electronic assembly when it is in one or more discrete positions relative to an electronic system containing the bus bar.

Further, bus bars are described as supplying power. It should be appreciated that providing a return path for current may be part of supplying power, such that a bus bar, as described herein, may be connected to a terminal of a power supply of positive or negative voltage that sources current or may be connected to a supply, ground or other suitable terminal that sinks current.

Moreover a bus bar is described as having conductive surface portions on a surface of a substrate. Such a bus bar may be constructed using known power PCB construction techniques in which the substrate is formed of alternating layers of conductive metal in insulator that are electrically connected with vias passing through the layers. In other embodiments, the conductive surfaces and the substrate may be integral. For example, the bus bar may be formed as a solid piece of metal, in which case the surface and the substrate would be portions of the same component. Other configurations are similarly possible, such as a bus bar formed by laminating multiple metal layers.

As an example of yet a further variation, it is described that each connector terminal has one or more contact fingers integrally formed with a base. Each base may have, for example, a single set of contact fingers with contact surfaces aligned in a row. Other construction techniques are possible. The contact fingers may be formed separately from the base and subsequently attached to it. The contact fingers may be attached by welding, brazing, soldering, crimping or in any other suitable way. Alternatively, multiple sets of contact fingers may be integrally formed with or attached to a single base. For example, the sets of contact fingers shown above as parts of separate connector terminals 200*a* and 200*c*, each with its own base, could be integrally formed with one longer base.

As yet another example, sliding of a bus bar relative to contact terminals is described. In a system as illustrated in FIG. 1, for example, relative sliding may be the result of opening or closing a drawer containing a PCB with region 150 thereon. In that configuration, the bus bar may have a fixed position and the PCB may move. However, relative sliding may result if the bus bar is in the drawer that moves relative to a region containing sliding contact terminals. Accordingly, it should be appreciated that sliding as used herein, unless otherwise qualified, refers to relative motion of components, without regard to which, if any, of the components is stationary.

Various aspects of the present invention may be used alone, in combination, or in a variety of arrangements not specifically discussed in the embodiments described in the foregoing and is therefore not limited in its application to the details and arrangement of components set forth in the foregoing description or illustrated in the drawings. For example, aspects described in one embodiment may be combined in any manner with aspects described in other embodiments.

Also, the invention may be embodied as a method, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

Use of ordinal terms such as "first," "second," "third," etc., in the claims to modify a claim element does not by itself connote any priority, precedence, or order of one claim element over another or the temporal order in which acts of a method are performed, but are used merely as labels to distinguish one claim element having a certain name from another element having a same name (but for use of the ordinal term) to distinguish the claim elements.

All definitions, as defined and used herein, should be understood to control over dictionary definitions, definitions in documents incorporated by reference, and/or ordinary meanings of the defined terms.

The indefinite articles "a" and "an," as used herein in the specification and in the claims, unless clearly indicated to the contrary, should be understood to mean "at least one."

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified.

The phrase "and/or," as used herein in the specification and in the claims, should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

Also, the phraseology and terminology used herein is for the purpose of description and should not be regarded as limiting. The use of "including," "comprising," or "having," "containing," "involving," and variations thereof herein, is meant to encompass the items listed thereafter and equivalents thereof as well as additional items.

What is claimed is:

1. An electrical connector terminal, comprising:
a conductive base;
a plurality of contact fingers integral with the base; and
a track integral with the base.

2. The electrical connector terminal of claim 1, further comprising a plurality of tails integral with the base.

3. The electrical connector terminal of claim 2, wherein the track comprises an opening, and the opening faces the plurality of contact fingers.

4. The electrical connector terminal of claim 3, wherein:
the connector terminal further comprises a tab coupled to the base;
the plurality of contact fingers have a rest state; and
the tab presses against the distal ends of at least a portion of the plurality of contact fingers such that distal ends of the contact fingers are offset in the second direction from their rest states, whereby the tab pre-loads the contact fingers.

5. The electrical connector terminal of claim 3, wherein:
the base comprises a first side facing a first direction and a second side facing a second direction opposite the first direction;
the track and the plurality of contact fingers are formed on the first side with at least a portion of the track and the plurality of contact fingers extending from the base in the first direction; and
the plurality of tails are formed on the second side with at least a portion extending in the second direction.

6. The electrical connector terminal of claim 5, wherein:
the track comprises a first surface parallel to the base and a second surface parallel to the first surface and offset from the first surface in the first direction;
the opening of the track is between the first surface and the second surface;
the plurality of contact fingers comprise contact surfaces at distal portions of the contact fingers; and
the contact surfaces of the plurality of contact fingers are spaced from the first surface of the track in the second direction.

7. The electrical connector terminal of claim 3, wherein:
the connector terminal further comprises a tab coupled to the base;
the tab is positioned adjacent the distal ends of at least a portion of the plurality of contact fingers; and
the tab is offset from the at least a portion of the plurality of contact fingers such that the tab blocks bending of the contact fingers in the first direction.

8. The electrical connector terminal of claim 7, wherein the tab is integral with the base.

9. The electrical connector terminal of claim 7, wherein the tab is separable from and clipped to the base.

10. An electronic assembly, comprising:

a plurality of electrical connector terminals, each of the plurality of electrical connector terminals comprising:

a conductive base;

a plurality of contact fingers integral with the base; and a track integral with the base, wherein:

the electrical connector terminal further comprises a plurality of tails integral with the base;

the track comprises an opening, and the opening faces the plurality of contact fingers, the base comprises a first side facing a first direction and a second side facing a second direction opposite the first direction;

the track and the plurality of contact fingers are formed on the first side with at least a portion of the track and the plurality of contact fingers extending from the base in the first direction;

the plurality of tails are formed on the second side with at least a portion extending in the second direction;

the track comprises a first surface parallel to the base and a second surface parallel to the first surface and offset from the first surface in the first direction;

the opening of the track is between the first surface and the second surface;

the plurality of contact fingers comprise contact surfaces at distal portions of the contact fingers; and the contact surfaces of the plurality of contact fingers are spaced from the first surface of the track in the second direction;

a first planar substrate, wherein the plurality of electrical connector terminals are mounted on the first planar substrate, and wherein the tails of the plurality of electrical connector terminals are electrically and mechanically coupled to the first planar substrate.

11. The electronic assembly of claim 10, wherein:

at least a first two of the plurality of electrical connector terminals are positioned with their tracks aligned; and at least a second two of the plurality of electrical connector terminals are positioned with their tracks aligned.

12. An electronic system, comprising:

an electronic assembly, comprising:

a plurality of electrical connector terminals, each of the plurality of electrical connector terminals comprising:

a conductive base;

a plurality of contact fingers integral with the base; and a track integral with the base, wherein:

the electrical connector terminal further comprises a plurality of tails integral with the base;

the track comprises an opening, and the opening faces the plurality of contact fingers, the base comprises a first side facing a first direction and a second side facing a second direction opposite the first direction;

the track and the plurality of contact fingers are formed on the first side with at least a portion of the track and the plurality of contact fingers extending from the base in the first direction;

the plurality of tails are formed on the second side with at least a portion extending in the second direction;

the track comprises a first surface parallel to the base and a second surface parallel to the first surface and offset from the first surface in the first direction;

the opening of the track is between the first surface and the second surface;

the plurality of contact fingers comprise contact surfaces at distal portions of the contact fingers; and the contact surfaces of the plurality of contact fingers are spaced from the first surface of the track in the second direction; and a first planar substrate, wherein the plurality of electrical connector terminals are mounted on the first planar substrate, and wherein the tails of the plurality of electrical connector terminals are electrically and mechanically coupled to the first planar substrate; and a second planar substrate, the second planar substrate comprising:

a first edge slidably mounted within the tracks of the first two of the plurality of electrical connector terminals;

a second edge slidably mounted within the tracks of the second two of the plurality of electrical connector terminals; and a first elongated conductive surface and a second elongated conductive surface between the first edge and the second edge, wherein:

contact surfaces on the plurality of contact fingers of the first two of the plurality of electrical connector terminals contact the first elongated conductive surface, and contact surfaces on the plurality of contact fingers of the second two of the plurality of electrical connector terminals contact the second elongated conductive surface.

13. The electronic system of claim 12, wherein:

the base of each of the plurality of connector terminals further comprises a tab;

at least a portion of the tab is positioned above the plurality of contact fingers in the first direction, and the tab restrains the contact fingers from bending towards the first direction.

14. The electronic system of claim 12, wherein the plurality of connector terminals are positioned on the first planar substrate in first and second rows along a direction perpendicular to the sliding direction and spaced from one another in the sliding direction.

15. The electronic system of claim 14, wherein the contact fingers of the connector terminals in the first row are offset from the contact fingers of the second row in the direction perpendicular to the sliding direction.

16. The electronic system of claim 14, wherein:

the distal ends of the plurality of contact fingers of the connector terminals in the first row extend towards the second row; and the distal ends of the plurality of contact fingers of the connector terminals in the second row extend towards the first row.

17. An electronic system, comprising:

a first substrate;

a plurality of connector terminals mounted to the first substrate, each of the plurality of connector terminals comprising:

a conductive base; and a plurality of contact fingers integral with the base, wherein the contact fingers comprise distal ends;

a plurality of guidance components mounted to the first substrate adjacent the plurality of connector terminals; and a second substrate slidably mounted between the plurality of guidance components, the second substrate comprising a contact surface thereon, wherein the contact surface is in contact with the distal ends of the contact fingers of at least one connector terminal of the plurality of connector terminals and the second substrate is slidable in a sliding direction.

18. The electronic system of claim 17, wherein the plurality of guidance components comprise first and second guide blocks.

19. The electronic system of claim 18, wherein:

the first guide block is spaced from the plurality of connector terminals in a direction perpendicular to the sliding direction, and the second guide block is spaced from the plurality of connector terminals in a direction perpendicular to the sliding direction and is on an opposite side of the plurality of connector terminals from the first guide block.

20. The electronic system of claim 19, wherein:

the first and second guide blocks each comprise an opening, and the opening of the first guide block faces the plurality of connector terminals and the opening of the second guide block faces the plurality of connector terminals.

21. The electronic system of claim 17, wherein the plurality of guidance components comprise a plurality of guide rollers.

22. The electronic system of claim 21, wherein a first portion of the plurality of guide rollers are spaced from a second portion of the plurality of guide rollers in the sliding direction.

23. The electronic system of claim 22, wherein at least a first two of the plurality of guide rollers are spaced from at least a second two of the plurality of guide rollers in a direction perpendicular to the sliding direction.

24. The electronic system of claim 23, wherein:

the first portion of the plurality of guide rollers are aligned with each other along the sliding direction, and the second portion of the plurality of guide rollers are aligned with each other along the direction perpendicular to the sliding direction.

25. An apparatus, comprising:

a plurality of electrical connector terminals, wherein each of the plurality of electrical connector terminals comprises a plurality of contact fingers, each of the plurality of contact fingers comprising a contact surface thereon;

a track, elongated in a sliding direction and configured to guide an edge of a bus bar, wherein the track is mechanically coupled to the connector terminal; and wherein:

at least a first of the plurality of electrical connector terminals is offset from a second of the plurality of electrical connector terminals in the sliding direction;

the contact surfaces of the plurality of contact fingers of the first electrical connector terminal are positioned to make wear paths on a bus bar sliding in the track that are interspersed with and offset, in a direction perpendicular to the sliding direction, from wear paths on the bus bar made by the contact surfaces of the plurality of contact fingers of the second electrical connector terminal.

26. The apparatus of claim 25, wherein:

each of the plurality of electrical connector terminals further comprises a conductive base; and the plurality of contact fingers extend from the base in a first direction.

27. The apparatus of claim 26, wherein:

each of the plurality of electrical connector terminals further comprises a plurality of tails extending from the base in a second direction, opposite the first direction, wherein the plurality of tails are configured for electrically and mechanically connecting to a first substrate.

28. The apparatus of claim 26, wherein:

the track comprises a plurality of segments; and each segment of the plurality of segments is integral with the base of the first of the plurality of electrical connector terminals and the second of the plurality of electrical connector terminals.

* * * * *